United States Patent [19]

Felix

[11] 4,027,414

[45] June 7, 1977

[54] RIFLE SCOPE MOUNT

[76] Inventor: Thomas R. Felix, 163 Bunker Ave., Meriden, Conn. 06450

[22] Filed: Jan. 5, 1976

[21] Appl. No.: 646,588

[52] U.S. Cl. ..... 42/1 ST; 33/250

[51] Int. Cl.[2] ..... F41G 1/38

[58] Field of Search ..... 42/1 ST, 42 1 S; 33/245, 247, 250

[56] References Cited

UNITED STATES PATENTS

| | | | |
|---|---|---|---|
| 2,450,466 | 10/1948 | Carlson | 42/1 ST |
| 2,597,466 | 5/1952 | Felix | 33/250 |
| 3,153,856 | 10/1964 | Felix | 42/1 ST |

*Primary Examiner*—Charles T. Jordan
*Attorney, Agent, or Firm*—Clarence A. O'Brien; Harvey B. Jacobson

[57] ABSTRACT

An elongated base is provided for mounting on a gun barrel with the base extending longitudinally of the barrel. The base includes opposite end portions and a longitudinally slotted mid-portion extending therebetween. A pair of scope mounting rings are seatable against the base on one side thereof through which the slot opens and include outstanding mounting lug portions projecting into and slidable along the slot of the base. The mounting lug portions include aligned bores extending therethrough longitudinally of the slot and an elongated shaft is disposed in the slot and extends through the bores. An abutment member opposes the opposite side of the body through which the slot also opens and includes an anchor lug projecting into the slot between the lug portions. The lug has a bore formed therethrough through which the shaft is snugly received and resilient structure is connected between the abutment member and the base for yieldingly biasing the abutment member in a direction extending outwardly of the side of the base opposed by the abutment member.

12 Claims, 7 Drawing Figures

RIFLE SCOPE MOUNT

BACKGROUND OF THE INVENTION

When a scope is mounted on a rifle or similar firearm, the mounting of the scope on the firearm must be precise. Various forms of scopes include mounting base portions from which the scope barrels thereof are supported and which may be readily removably supported in a stationary manner from the barrel of an associated firearm. This type of removable mounting of a scope is most desirable and yet presents problems in assuring identical positioning of the scope on the firearm each time it is mounted.

While the removable mounting of a scope base upon a rifle barrel has been developed to the extent that substantially identical repositioning of the scope base may be obtained each time the scope base is mounted on an associated firearm, the scope itself represents a delicate instrument and difficulty has been encountered in providing suitable means for mounting a scope barrel from the scope mount. The barrel of a scope is sensitive to temperature changes and restrained expansion and contraction of the scope barrel can adversely effect the scope optics. The gun barrel upon which the scope base may be mounted is subject to temperature changes and the usual mounting lug provided on a scope can transmit considerable expansion stress forces to the scope barrel upon the barrel of the firearm being heated as a result of the firearm being fired.

BRIEF DESCRIPTION OF THE INVENTION

The scope mount of the instant invention includes a base having structure for ready removable attachment to an associated gun barrel and structure for mounting the scope from the base in a manner so as to compensate for expansion and contraction due to temperature changes and to also reduce the amount of shock transmitted to the scope as a result of the associated firearm being fired.

The main object of this invention is to provide a scope mount for support of a scope from a rifle barrel or the like in a manner so as to allow for relative expansion and contraction of the gun and scope barrels due to temperature changes without adversely affecting the optics of the scope.

Another object of this invention, in accordance with the immediately preceding object, is to provide a scope mount which will operate to lessen the amount of shock transmitted to the scope as a result of the associated firearm being fired.

Another important object of this invention is to provide a scope mount which may be utilized in conjunction with scopes presently being produced by many scope manufacturers.

A final object of this invention to be specifically enumerated herein is to provide a scope mount in accordance with the preceding objects and which will conform to conventional forms of manufacture, be of simple construction and easy to use so as to provide a device that will be economically feasible, long lasting and relatively trouble-free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 1:
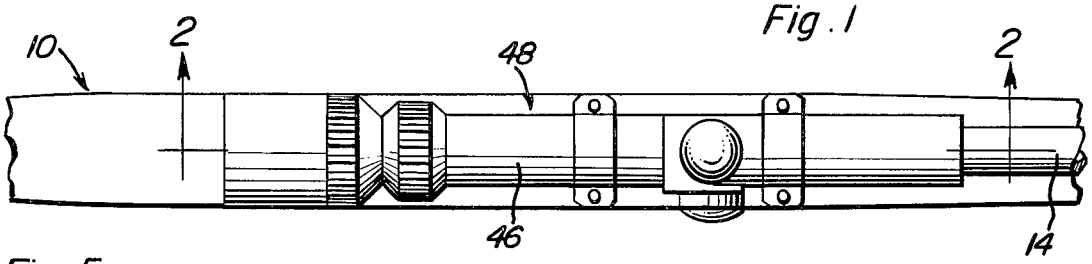
FIG. 1 is a fragmentary top plan view of a rifle having a scope mounted thereon through the utilization of the scope mount of the instant invention.
Figure 5:
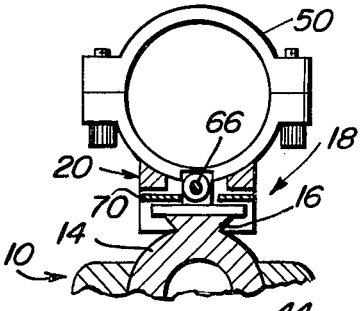
FIG. 5 is a transverse vertical sectional view taken substantially upon the plane indicated by the section line 5—5 of FIG. 2.
Figure 6:
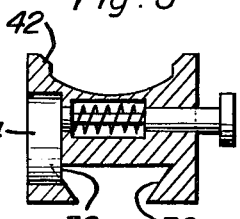
FIG. 6 is an enlarged transverse vertical sectional view taken substantially upon the plane indicated by the section line 6—6 of FIG. 2.
Figure 2:
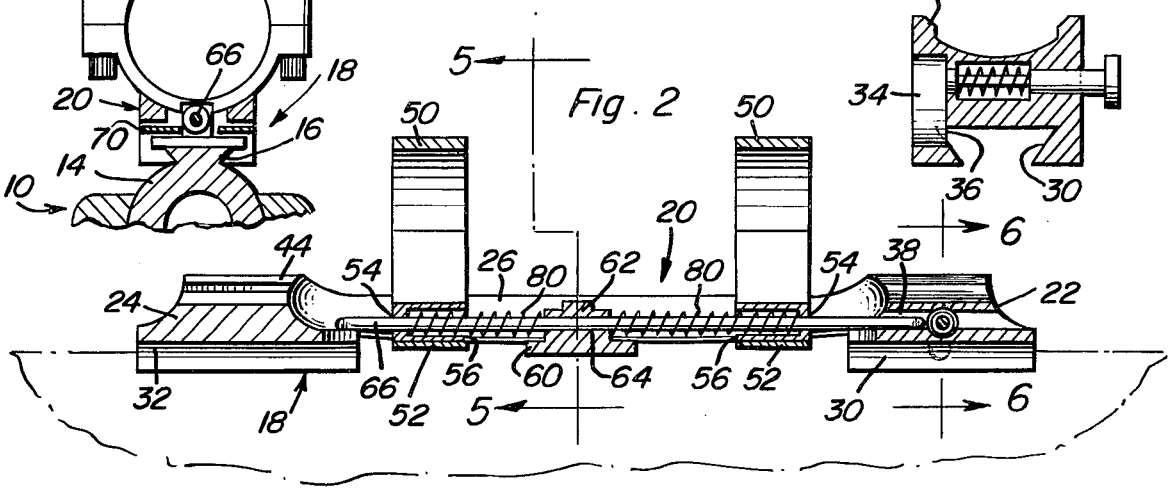
FIG. 2 is an enlarged longitudinal vertical sectional view taken substantially upon a plane indicated by the section line 2—2 of FIG. 1 and with the rifle illustrated in phantom lines and the associated scope barrel removed.
Figure 3:
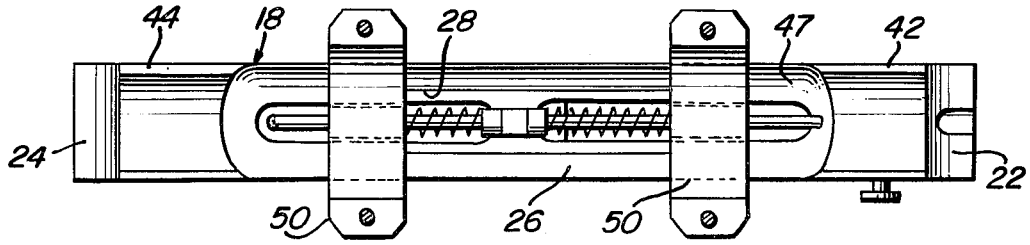
FIG. 3 is a top plan view of the scope mount.
Figure 4:
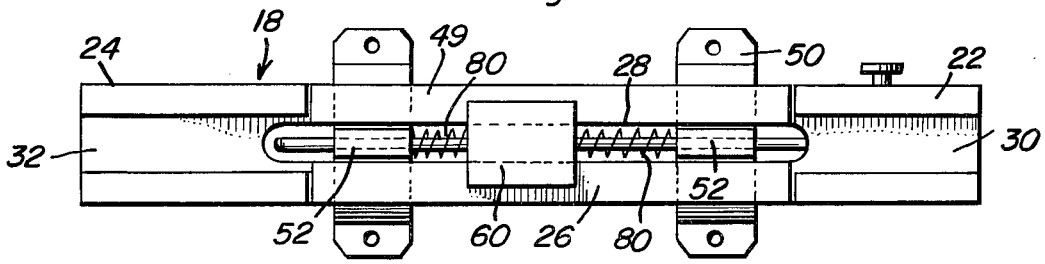
FIG. 4 is a bottom plan view of the scope mount.
Figure 7:
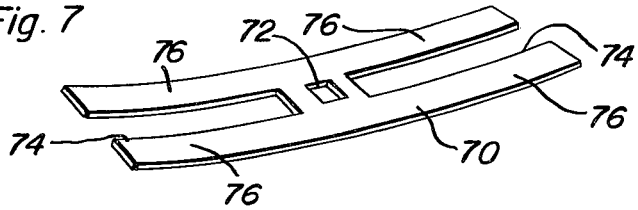
FIG. 7 is a perspective view of the leaf spring portion of the invention.

Referring now more specifically to the drawings, the numeral 10 generally designates a rifle including a barrel 14 having a pair of longitudinally spaced dove-tailed mounting lugs 16 thereon.

The scope mount of the instant invention is referred to in general by the reference numeral 18 and includes an elongated body generally referred to by the reference numeral 20. The body 20 includes opposite end portions 22 and 24 and also an intermediate portion 26 extending between and rigidly interconnecting the end portions 22 and 24. The intermediate portion 26 has a longitudinal slot 28 formed therein opening both upwardly and downwardly through the intermediate portion 26.

The underside portions of the end portions 22 and 24 have dove-tailed grooves 30 and 32 formed therein snugly engageable with the dove-tailed projections 16 in order to mount the base 20 on the barrel 14, the end portion 22 having a spring biased abutment 34 supported therefrom including a portion 36 projectable into the groove 30 for interlocking engagement with the corresponding dove-tailed projection 16 in order to lock the base 20 on the barrel 14.

The end portion 22 includes a longitudinally passage 38 extending therethrough and the upper surfaces of the end portions 22 and 24 define centrally recessed partial cylindrical seating surfaces 42 and 44 for seated engagement of the barrel portion 46 of the scope referred to in general by the reference numeral 48 on the end portions 22 and 24.

The upper surface 47 of the intermediate portion 26 is partially cylindrical and the upper end of the slot 28 opens upwardly through the surface 47 while the lower end of the slot 28 opens downwardly through the generally planar undersurface 49 of the intermediate portion 26.

A pair of split-type clamp rings 50 are provided and are clamped about longitudinally spaced portions of the body tube or barrel portion 46 of the scope 48. The clamp rings 50 include lower side outwardly projecting lug portions 52 having aligned bores 54 formed therethrough including adjacent end counterbores 56.

The clamp rings 50 include outer cylindrical surfaces of substantially the same radius as the upwardly facing semi-cylindrical seating surfaces 42 and 44 and the lug portions 52 are slidingly received in the slot 28 with the lower cylindrical surface portions of the clamp rings 50 opposing the surface 47.

An abutment plate or member 60 underlies the surface 49 and includes a lug 62 projecting into and slidingly received in the slot 28. The lug 62 includes a bore 64 aligned with the bores 54 and a shaft 66 is disposed in and extends longitudinally of the slot 28 and passes through the bores 54 and 64. One end of the shaft 66 is loosely received in the end portion of the passage 38 opening into the slot 28 and an elongated bowed leaf spring 70 is provided with a central opening 72. The leaf spring 70 underlies the surface 49 and the lug 62 is received upwardly through the opening 72. The opposite ends of the leaf spring 70 include longitudinal slots 74 which open endwise outwardly of the corresponding ends of the spring 70. The slots 74 define opposite side furcations or legs 76 at the opposite ends of the spring 70 and the legs 76 closely underlie the portions of the surface 49 on opposite sides of the slot 28.

The spring 70, in its unflexed condition, is upwardly concaved and the portions of the central area of the spring 70 which surround the opening 72 thereby press downwardly on the upper side of the plate 60 about the lug 62 in order that the lug 62 may pull downwardly on the lug portions 52 and thus the clamp rings 50. Accordingly, inasmuch as the clamp rings 50 are clamped about the barrel or tube 46 of the scope 48, the opposite end portions of the barrel portion 46 are pulled downwardly into engagement with the corresponding partial cylindrical seating surfaces 42 and 44 of the end portions 22 and 24. A pair of coiled compression springs 80 are disposed about the shaft 66 between the lug 62 and the lug portions 52 and the remote ends of the springs 80 are seated in the counter-bores 56 while the adjacent ends of the springs 80 bear against the opposing remote faces of the lug 62 through which the opposite ends of the bore 64 open.

It may thus be seen that the barrel or tube 46 of the scope 48 is supported from the mount 18 in a manner enabling expansion or contraction of the tube or barrel 46 due to temperature changes. Further, inasmuch as the clamp rings 50 are slidably mounted on the shaft 66 but are spring biased toward predetermined positions, the recoil resulting from firing the rifle 10 is not fully transmitted to the scope 48. Accordingly, the optics of the scope 48 are less likely to be adversely affected by shock.

If it is desired, the slot 28 may be replaced by three separate elongated openings or slots extnding longitudinally of the body 20. Further, it is not absolutely necessary that one end of the shaft 66 be loosely recieved in the passage 38 inasmuch as some other means (not shown) could be utilized to maintain the longitudinal positioning of the shaft 66.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. In combination, a scope mount including an elongated base for mounting on a gun barrel with the base extending longitudinally of said barrel, said base including opposite end portions and a longitudinally slotted mid-portion extending therebetween, a pair of scope mounting rings seatable against said base on one side thereof through which said slot opens and including outstanding mounting lug portions projecting into and slidable along said slot, said mounting lug portions including aligned bores extending therethrough longitudinally of said slot, an elongated shaft disposed in said slot, extending therealong and received through said bores, an abutment member opposing the opposite side of said base through which said slot also opens, said abutment member including an anchor lug projecting into said slot between said lug portions and having a bore formed therethrough through which said shaft is received, and resilient means connected between said abutment member and said base yieldingly biasing said abutment member in a direction extending outwardly of said opposite side of said base.

2. The combination of claim 1 wherein one of said end portions of said base includes a passage extending longitudinally of said base and opening outwardly into one end of said slot, one end of said shaft being loosely received in said passage.

3. The combination of claim 1 wherein said resilient means includes an elongated leaf spring whose opposite ends abut said opposite side of said base, said leaf spring being longitudinally bowed with the longitudinal mid-portion thereof disposed between said opposite side and said abutment member.

4. The combination of claim 3 wherein said longitudinal mid-portion has an opening formed therethrough through which said lug projects.

5. The combination of claim 4 wherein the opposite ends of said leaf spring have longitudinal endwise opening slots formed therein through which said lug portions project.

6. The combination of claim 5 wherein one of said end portions of said base includes a passage extending longitudinally of said base and opening outwardly into one end of said slot, one end of said shaft being loosely received in said passage.

7. The combination of claim 1 wherein said aligned bores include adjacent end counterbores, a pair of coiled compression springs disposed on said shaft, having their remote ends seated in said counterbores and their adjacent ends opposing corresponding sides of said lug.

8. The combination of claim 7 wherein said resilient means includes an elongated leaf spring whose opposite ends abut said opposite side of said base, said leaf spring being longitudinally bowed with the longitudinal mid-portion thereof disposed between said opposite side and said abutment member.

9. The combination of claim 8 wherein said longitudinal mid-portion has an opening formed therethrough through which said lug projects.

10. The combination of claim 9 wherein the opposite ends of said leaf spring have longitudinal endwise outwardly opening slots formed therein through which said lug portions project.

11. In combination, a scope mount including an elongated base for mounting on a gun barrel with the base extending longitudinally of said barrel, said base including opposite end portions and a longitudinally slotted midportion extending therebetween, a pair of scope mounting members seatable against and slidable along said base on one side thereof through which said slot opens and including outstanding mounting lug portions projecting into and slidable along said slot, said mounting lug portions including aligned bores extending therethrough longitudinally of said slot, an elongated shaft disposed in said slot, extending therealong and slidingly received through said bores, an abutment member opposing the opposite side of said base through which said slot also opens, said abutment member including an anchor lug projecting into said slot between said lug portions and having a bore formed therethrough through which said shaft is received, and resilient means connected between said abutment member and said base yieldingly biasing said abutment member in a direction extending outwardly of said opposite side of said base.

12. The combination of claim 11 including coiled compression springs disposed about said shaft and interposed between the opposite sides of said abutment member through which said bore opens and said mounting lug portions.

* * * * *